United States Patent [19]

Yamazaki et al.

[11] 4,319,215

[45] Mar. 9, 1982

[54] NON-LINEAR RESISTOR AND PROCESS FOR PRODUCING SAME

[75] Inventors: Takeo Yamazaki; Tadahiko Miyoshi, both of Hitachi, Japan

[73] Assignee: Hitachi, Ltd., Tokyo, Japan

[21] Appl. No.: 163,296

[22] Filed: Jun. 26, 1980

[30] Foreign Application Priority Data

Jul. 13, 1979 [JP] Japan ..... 54-88265

[51] Int. Cl.[3] ..... H01C 7/10

[52] U.S. Cl. ..... 338/21; 106/53; 106/54; 501/61; 501/62; 501/75; 501/67; 501/135; 252/521

[58] Field of Search ..... 338/20, 21; 252/519, 252/521; 106/53, 54

[56] References Cited

FOREIGN PATENT DOCUMENTS 53-22273 7/1978 Japan ..... 338/21

*Primary Examiner*—C. L. Albritton

*Attorney, Agent, or Firm*—Craig and Antonelli

[57] ABSTRACT

Disclosed is a non-linear resistor of a sintered ZnO ceramics, which has a glass coating having a baking temperature higher than 850° C. but a temperature lower than the sintering temperature of the sintered ZnO ceramics, and has a composition:

(a) 30 to 75% by weight of $SiO_2$,
(b) 0.3 to 15% by weight of at least $B_2O_3$ and PbO,
(c) 2 to 30% by weight of $Al_2O_3$,
(d) less than 30% by weight of an alkaline earth metal oxide,
(e) less than 40% by weight of ZnO,
(f) less than 25% by weight of $TiO_2$, and
(g) less than 5% by weight of an alkali metal oxide.

The glass coating baked at a range of 850° C. to 1300° C. provides non-linear resistors having a large non-linear coefficient and a high impulse current resistance as well as a good resistance to an acid and water.

10 Claims, 2 Drawing Figures

NON-LINEAR RESISTOR AND PROCESS FOR PRODUCING SAME

DETAILED DESCRIPTION OF THE INVENTION

The present invention relates to a non-linear resistor of a sintered body composed mainly of zinc oxide, which can be used for an arrester or surge absorber, and a process for the preparation thereof.

Zinc oxide type non-linear resistors are ordinarily prepared by the well-known ceramic sintering technique. In broad outline, the preparation process according to this conventional technique comprises adding bismuth oxide, antimony oxide, cobalt oxide, chromium oxide, boron oxide, manganese oxide, nickel oxide and the like to powder of zinc oxide as the main component, mixing them sufficiently, adding water and an appropriate binder such as polyvinyl alcohol to the mixture, forming the mixture into moldings, calcining the moldings at a temperature of 900° to 1400° C. by an electric furnace, forming a coating of a low-melting-point glass of the lead borosilicate or zinc borosilicate type on the side face of the sintered body by baking at 500° to 800° C. so as to prevent surface discharge, polishing in a predetermined depth both the end faces of the sintered body, on which electrodes are to be formed, and forming electrodes on both the end faces by spraying or baking, thereby to form a non-linear resistor. British Pat. No. 1,244,745, U.S. Pat. No. 3,764,566, and U.S. Pat. No. 3,872,582 constitute the prior arts to the present invention.

Resistors prepared according to this conventional process, however, have several defects. The first defect is that when a glass such as mentioned above is baked at 500° to 800° C. on the sintered body resistor, the non-linear coefficient of the resistor becomes lower than that before baking.

The second defect is that since the chemical resistance of the used glass is poor, when the etching treatment is carried out before deposition of electrodes or if the resistor is used in the state where it is sealed in nitrogen as in case of an arrester, the glass is corroded by nitric acid gas formed by corona and the surface breakdown strength of the resistor is reduced.

SUMMARY OF THE INVENTION

It is an object of the present invention to eliminating the foregoing defects. It is another object of the present invention to provide a non-linear resistor which is stable in properties such as the non-linear coefficient and a process for the preparation thereof.

In accordance with the present invention, there is provided a non-linear resistor made of a sintered body whose main ingredient is zinc oxide, the face of which is coated with a glass coating baked at a temperature higher than 850° C. but lower than a sintering temperature of the sintered body having electrodes formed on an exposed face thereof.

DETAILED DESCRIPTION OF THE INVENTION

Figure 1:
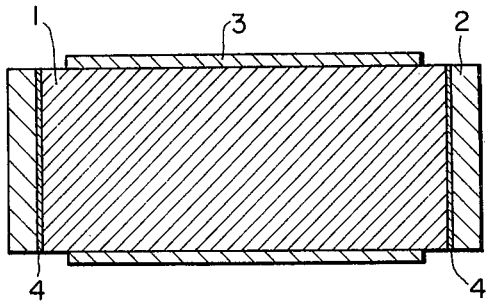
FIG. 1 is a section view of a structure of the non-linear resistor according to the present invention.
Figure 2:
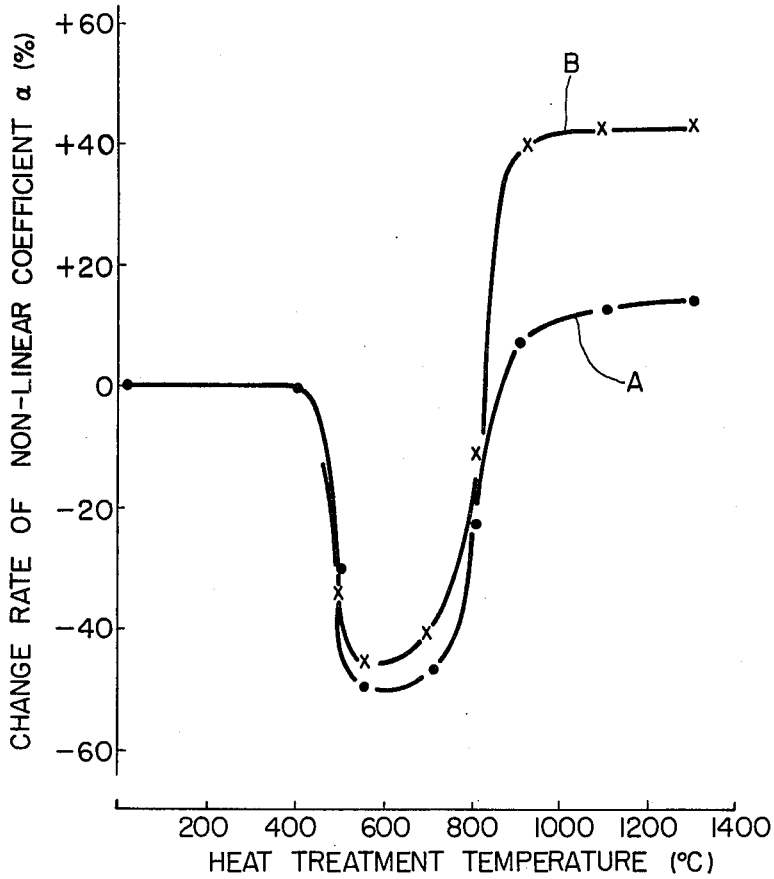
FIG. 2 is a curve showing the relationship between a heat treatment temperature and a change rate of non-linear coefficient $\alpha$ (%).

In order to improve the adhesion of electrodes to the resistor, it is preferred that the polished surface of the resistor be lightly etched with an acid such as hydrochloric acid or nitric acid. For this purpose, it is necessary to use an acid-resistant glass as the coating glass.

Ordinarily, increase of the $SiO_2$ content in the glass results in increase of the acid resistance of the glass and also in increase of the softening temperature of the glass. If the glass has such a high softening temperature as 700° C. or higher, it has the corrosion resistance against an acidic etching solution.

When a baking treatment is carried out at 400° to 800° C., the phase change of $Bi_2O_3$ in the sintered body results in the reduction of the non-linear coefficient. However, when a baking temperature is higher than the melting point of $Bi_2O_3$ (about 820° C.), the same phase as that after sintering is formed and the non-linear coefficient is not lowered too much. When the heat treatment is carried out in oxygen, large quantities of oxygen ions are adsorbed on the surfaces of particles of zinc oxide, resulting in increase of the non-linear coefficient. A temperature between the softening temperature of the glass and the working temperature is selected as the glass baking temperature.

An acid resistance of the glass coating should be good so that, when the resistor is sealed in a nitrogen atmosphere as in case of an arrester, the resistor is not etched by nitric acid formed by corona.

In the preparation of the non-linear resistor of the present invention, the sintered body should contain at least 50 molar % of ZnO, and 0.01 to 10 mol % of various kinds of oxides such as bismuth oxide, manganese oxide, cobalt oxide, antimony oxide, chromium oxide, boron oxide, silicon oxide, nickel oxide, phosphorous oxide, praceodium oxide, or neodium oxide singly or in combination. The resulting mixture is sintered at 1000° to 1400° C.

In the present invention, in order to improve the adhesion of the glass coating to the resistor and prevent surface flashover, it is necessary that the glass coating should have a thickness of at least about 20 $\mu$m. Accordingly, it is required that the linear expansion coefficient of the glass should be close to that of the resistor. Since the linear expansion coefficient ($\alpha_{ZnO}$) of the zinc oxide resistor is (50 to 70)$\times 10^{-7}$/°C., the linear expansion coefficient of the glass should be in the range of $\alpha_{ZnO} \pm 20 \times 10^{-7}$/°C. If the difference of the linear expansion coefficient is large, when cooling is performed after the heat treatment, cracks or similar flaws are formed on the glass, and therefore, the stability to application of electricity is reduced and no satisfactory effect of preventing surface flashover is attained. It also is required that the contents of alkali metals such as Na, K and Li in the glass should be as low as possible, preferably less than 5% by weight.

The high softening temperature glass used in the present invention should contain 30 to 75% by weight, preferably, 45 to 75% by weight of silicon oxide ($SiO_2$) and 0.3 to 15% by weight of boron oxide ($B_2O_3$) and/or lead oxide (PbO). If the content of silicon oxide is higher than 75% by weight or the content of boron oxide and/or lead oxide is lower than 0.3% by weight, the softening point of the glass and the working temperature become too high and the glass baking temperature is higher than the sintering temperature, and furthermore, the linear expansion coefficient of the glass becomes lower than $30\times10^{-7}/°C$. In contrast, when the content of silicon oxide is lower than 30% by weight or the content of boron oxide and/or lead oxide is higher than 15% by weight, the working temperature becomes lower than 800° C. and the acid resistance of the glass is reduced. In order to improve the acid resistance of the glass, it is preferred that the boron oxide and/or lead oxide content be 0.5 to 10% by weight.

The glass that is used in the present invention may contain less than 30% by weight, preferably about 5 to 20% by weight of an alkaline earth metal oxide such as magnesium oxide (MgO), calcium oxide (CaO) or barium oxide (BaO).

If the content of zinc oxide (ZnO) is too high, the acid resistance of the glass is reduced and the impulse current resistance of a non-linear resistor is lowered. Accordingly, it is preferred that zinc oxide content be lower than 40% by weight, preferably 5 to 25% by weight.

In order to improve the acid resistance, it is especially preferred that aluminum oxide ($Al_2O_3$) be contained in the glass in an amount of 2 to 30% by weight. The added aluminum oxide has a function of preventing phase separation in the glass and improving the acid resistance. However, if the aluminum oxide content is too high, the glass baking temperature becomes too high and stress are readily left in the glass.

An especially preferred composition of the high softening temperature glass used in the present invention is 35 to 75% by weight of $SiO_2$, 0.5 to 10% by weight of $B_2O_3$ and/or PbO, 5 to 30% by weight of $Al_2O_3$, 5 to 40% by weight of ZnO, less than 30% by weight of alkaline earth metal oxides and less than 25% of $TiO_2$.

When a highly resistant ceramic layer composed of $Zn_7Sb_2O_{12}$ and $Zn_2SiO_4$ is formed in the interface between the glass layer and the resistor, the surface resistance of the resistor to flash over can be remarkably improved.

According to the results of a large number of experiments, the best composition of the glass coating is as follows:

(a) 35 to 45% by weight of $SiO_2$
(b) 15 to 25% by weight of $Al_2O_3$
(c) 1 to 5% by weight of at least one of $B_2O_3$ and PbO
(d) 5 to 15% by weight of ZnO
(e) 10 to 15% by weight of $TiO_2$
(f) less than 5% by weight of an alkali metal oxide
(g) 2 to 10% by weight of an alkaline earth metal oxide, and
(h) a small amount of other metal oxides such as $ZrO_2$.

In the present invention, the softening temperature and working temperature are defined as follows:

(1) Softening temperature is a temperature at which a glass exhibits $10^{7.6}$ poises. The measuring method is defined as in J. Soc. Glass tech. 24, 176 (1940).
(2) Working temperature is a temperature at which a glass exhibits $10^4$ poises. The measuring method is defined as in J. Am. Cer. Soc. 22, 367 (1939).

The baking temperature determined by the composition of glass used should be chosen between the softening temperature and the working temperature.

Baking is preferably carried out in an oxygen containing atmosphere so as to prevent a loss of oxygen atoms from the non-linear resistor and glass coating.

The present invention will be described in detail by the following examples.

EXAMPLE 1

In a ball mill, 2360 g of zinc oxide (ZnO), 70 g of bismuth oxide ($Bi_2O_3$), 25 g of cobalt oxide ($Co_2O_3$), 87 g of antimony oxide ($Sb_2O_3$), 13 g of manganese oxide ($MnO_2$), 23 g of chromium oxide ($Cr_2O_3$) and 9 g of $SiO_2$ were wet-blended for 15 hours. The mixture was dried and granulated to form moldings having a diameter of 12 mm and a thickness of 6 mm. The moldings were sintered at 1250° C. in air for 2 hours.

Powder of glass No. 1 shown in Table 3 as the high softening temperature glass was suspended in a trichlene solution of ethylcellulose and the suspension was brush-coated on the side face of the sintered body resistor in a thickness of about 150 μm. The coated resistor was baked at 1000° C. in the open air for 30 minutes. The temperature elevating and lowering rates adopted were 100° C./hour, respectively.

Both the end faces of the sintered resistor 1 having a glass coating 2 on the side face thereof, a thickness of the glass coating being about 25 μm, were polished in a depth of about 0.5 mm by a lapping machine and rinsed with trichlene at 60° C. Al was deposited by flash-spraying on the rinsed end faces of the resistor to form electrodes. The so formed resistor of the present invention was compared with a control which has a glass coating of a low softening temperature glass of the lead borosilicate type baked at 700° C. with respect to the non-linear coefficient. The obtained results are shown in Table 1.

TABLE 1

| | Product of Present Invention | Control 1 |
|---|---|---|
| Kind of Glass Used | No. 1 of Table 3 | No. 8 of Table 3 |
| Baking Condition | 1000° C., 1 hour | 700° C., 1 hour |
| Non-Linear Coefficient (10 μAα 1 mA) | 70–90 | 30–50 |

EXAMPLE 2

In the same manner as described in Example 1, 2360 g of zinc oxide (ZnO), 70 g of bismuth oxide ($Bi_2O_3$), 25 g of cobalt oxide ($Co_2O_3$), 13 g of manganese oxide ($MnO_2$), 87 g of antimony oxide ($Sb_2O_3$), 23 g of chromium oxide ($Cr_2O_3$), 9 g of silicon oxide ($SiO_2$) and 4 g of boron oxide ($B_2O_3$) were wet-blended for 15 hours in a ball mill, and the resulting mixture was dried and granulated. The granules were shaped into moldings having a diameter of 12 mm and a thickness of 6 mm. The moldings were sintered at 1230° C. for 2 hours in the open air. The sintered resistor was coated with a glass paste of glass No. 1 used in Example 1 in a thickness of 100 to 200 μm, and the coated resistor was heat-treated at 1050° C. for 1 hour in the open air. Both of the end faces of the glass-coated resistor were polished in a depth of about 0.8 mm by a lapping machine and washed. The washed resistor was directly subjected to flash-spraying of Al to form electrodes (control 2). Separately, the polished and washed resistor without being heat-treated was dipped in an etching solution of hydrochloric acid/water (volume ratio of 1/9) for 5 minutes to etch the polished end faces. Then, electrodes were formed by flash-spraying of Al to obtain a resistor. Characteristics of the resistors are shown in Table 2, from which it is seen that the proper etching to the glass coating is useful to produce the product having a higher non-linear coefficient, a higher varistor voltage and a smaller voltage change ratio under application of electricity than the product which has been subjected to no etching treatment and that the impulse current resistance of the product having been etched is higher than that of the product having been subjected to no etching.

When a resistor formed by using a glass of the lead borosilicate or zinc borosilicate type was similarly etched, the glass was dissolved out, and the surface breakdown strength was drastically reduced and the impulse current resistance was lower than 1000 A.

TABLE 2

| | Product of Present Invention | Control 2 |
|---|---|---|
| Voltage-Current Characteristics | | |
| Non-linear coefficient (10 μAα 1 mA) | 90–105 | 50–60 |
| Varistor voltage (V/mm) | 195–210 | 180–200 |
| Voltage Change Rate after Application of Current of 1 mA at 80° C. for 500 Hours | −0.5% | −6.5% |
| Impulse Current Resistance (8 × 20 μs) | 4450 A | 1900 A |

EXAMPLE 3

In the same manner as described in Example 1, zinc oxide (ZnO) 2340 g, bismuth oxide ($Bi_2O_3$) 140 g, cobalt oxide ($Co_2O_3$) 25 g, manganese carbonate ($MnCO_3$) 17 g, antimony oxide ($Sb_2O_3$) 88 g, nickel oxide (NiO) 23 g, chromium oxide ($Cr_2O_3$) 5 g and silicon oxide ($SiO_2$) 5 g were blended in a ball mill for 15 hours. The mixture was dried, granulated, and molded to obtain moldings having a diameter of 12 mm and a thickness 6 mm. The moldings were coated with a paste of a mixture of $SiO_2$-$Sb_2O_3$-$Bi_2O_3$ and sintered at 1270° C. for 2 hours. As a result, a layer of high resistive substance ($Zn_7Sb_2O_{12}$ and $Zn_2SiO_4$) was formed on the surface thereof. A glass shown in Table 3 was coated on the resistive layer on the side face of the sintered body in a thickness of 100 to 200 μm and the coated resistor was heat-treated at temperatures shown in Table 4 for 1 hour in the open air. The glass-coated resistor was polished on the both end faces in a depth of about 0.5 mm by a lapping machine. The polished resistor was dipped in an etching solution of $HNO_3$/HF (7/1 by volume) for 2 minutes to etch the polished faces, and electrodes were formed by flash-spraying of Al. According to the above procedures, a resistor comprising a highly resistant ceramic layer 4 composed of $Zn_7Sb_2O_{12}$ and $Zn_2SiO_4$, which was formed on the side face, and a glass layer formed thereon, was obtained.

The amount of the glass dissolved out was determined to obtain results shown in Table 4, from which it is seen that the acid resistance differs according to the glass composition and alumina silicate glass has a highest acid resistance. The impulse current resistance was determined to obtain results shown in Table 5. It is seen that glass No. 3 has the highest impulse current resistance and alumina silicate glass (glass No. 1) and borosilicate glass (glass No. 10) come next. It is seen that the impulse current resistances of glasses having sodium oxide ($Na_2O$) and boron oxide ($B_2O_3$) contents (glass Nos. 2, 6 and 7), which are too high, are comparable to that of the conventional element. In these samples, the non-linear coefficient is improved by the etching treatment and they are excellent over the conventional element in the stability against continuous application of an electric current of 1 mA. However, the acid resistance of the glass is relatively insufficient and therefore, the impulse current resistance is not improved. On the other hand, in samples Nos. 1, 3 and 9 having a preferred glass composition of the present invention, the impulse current resistance is at least 1.5 times the impulse current resistance of the conventional resistor.

TABLE 3

| No. | Composition of glass (% by weight) | | | | | | | | | | | Thermal expansion coefficient | Working temperature | Softening temperature |
|---|---|---|---|---|---|---|---|---|---|---|---|---|---|---|
| | $SiO_2$ | $Al_2O_3$ | $B_2O_3$ | ZnO | PbO | $TiO_2$ | MgO | CaO | $SnO_2$ | $Na_2O$ | etc. | ($10^{-7}$/°C.) | (°C.) | (°C.) |
| 1 | 58 | 23 | 1 | — | — | — | 11 | 5 | — | 1.3 | 0.7 | 42 | 1190 | 915 |
| 2 | 75 | 2.4 | 12.7 | — | — | — | — | — | — | 4.6 | 5.3 | 40 | 1150 | 780 |
| 3 | 39 | 22 | — | 14.3 | 4.4 | 12.9 | 0.2 | 7.1 | — | — | 0.2 | 52 | 1100 | 740 |
| 4 | 10.4 | 2.0 | 16.8 | 52.6 | 7.5 | 7.1 | — | — | 1.7 | — | 1.9 | 45 | 980 | 660 |
| 5 | 4.3 | 0.2 | 17.4 | 61.5 | 12.8 | — | — | — | 1.7 | — | 2.1 | 43 | 1000 | 680 |
| 6 | 62 | 7.0 | 24.1 | — | — | — | — | — | — | 4.1 | 2.8 | 45 | 1070 | 700 |
| 7 | 67.8 | 6.5 | 19.8 | — | — | — | — | — | — | 3.1 | 2.8 | 54 | 980 | 675 |
| 8 | 27.7 | 6 | 0.1 | — | 65.2 | — | — | — | — | — | 1.1 | 60 | 730 | 670 |
| 9 | 60 | 18 | 10 | — | — | — | 7 | 5 | — | — | — | 40 | 1150 | 800 |
| 10 | 70 | 5 | 17 | — | 3 | — | 5 | — | — | — | — | 42 | 1150 | 800 |

TABLE 4

| Sample No. (Baking temp.) | Etched amount μ(g/min.cm²) | | | | | | | | | |
|---|---|---|---|---|---|---|---|---|---|---|
| | No. 1 (1000° C.) | No. 2 (950° C.) | No. 3 (1000° C.) | No. 4 (900° C.) | No. 5 (900° C.) | No. 6 (950° C.) | No. 7 (950° C.) | No. 8 (720° C.) | No. 9 (1000° C.) | No. 10 (1000° C.) |
| Etchant | | | | | | | | | | |
| HCl: 1 ml $H_2O$: 2 ml | 21 | 12,000 | 5 | 22,000 | 20,000 | 18,000 | 16,000 | 65,000 | 42 | 2,400 |
| $HNO_3$ : 1 ml $H_2O$: 2 ml | 30 | 9,000 | 6 | 16,000 | 18,000 | 10,000 | 9,500 | 48,000 | 66 | 1,800 |
| $HNO_3$: 1 ml $H_2O$: 4 ml HF: 1 ml | 100 | 7,500 | 20 | 31,000 | 30,000 | 8,000 | 7,500 | 47,000 | 240 | 1,900 |

TABLE 5

| Glass No. | Impulse Current Resistance (A) |
|---|---|
| 1 | 4450 |
| 2 | 2000 |
| 3 | 6500 |
| 4 | 3000 |
| 5 | 3100 |
| 6 | 2090 |
| 7 | 1990 |
| 8 | 1900 |
| 9 | 3500 |
| 10 | 3000 |

EXAMPLE 4

In the same manner as described in Example 1, zinc oxide (ZnO) 2340 g, bismuth oxide ($Bi_2O_3$) 140 g, cobalt oxide ($Co_2O_3$) 25 g, manganese carbonate ($MnCO_3$) 17 g, antimony oxide ($Sb_2O_3$) 88 g, silicon oxide ($SiO_2$) 7 g and boron oxide ($B_2O_3$) 2 g were blended in a ball mill for 15 hours. The mixture was dried and granulated. The granules were molded to form moldings having a diameter of 12 mm and a thickness of 6 mm. In the same manner as described in Example 1, the moldings were sintered at 1250° C. for 2 hours. The sintered body resistor was coated with glass No. 1 having a high acid resistance or glass No. 2 having a relatively low acid resistance in a thickness of 100 to 200 μm in the same manner as described in Example 1. The coated resistor was heat-treated in the open air at 1100° or 1000° C. for 30 minutes. The temperature elevating or lowering rate was 200° C./hour. The glass-coated resistor was polished on both end faces thereof in a depth of about 0.5 mm. In the same manner as described in Example 3, the polished faces were etched with an etching solution of $HNO_3$/HF (7/1 by volume) by dipping in the etching solution for 2 minutes, and electrodes were formed by flash-spraying of Al. The so obtained resistor was sealed in a nitrogen atmosphere and subjected to corona discharge. Characteristics of the resistor were determined before and after the corona discharge. Characteristics determined before and after the corona discharge being carried out for 1 hour are shown in Table 6. In case of glass No. 1 formed by using an acid-resistant glass, the impulse current resistance was hardly changed by the corona discharge, and in case of glass No. 2 formed by using a glass having a relatively low acid resistance, the impulse current resistance was reduced by about 10% by the corona discharge.

An element coated with a glass No. 8 was similarly tested. It was found that the impulse current resistance was reduced by more than 30% by the corona discharge.

TABLE 6

| Glass No. | Baking Condition | Impulse Current Resistance (8 × 20 μs) before corona discharge | after corona discharge |
|---|---|---|---|
| 1 | 1100° C., 30 minutes | 4450 | 4440 |
| 2 | 1000° C., 30 minutes | 2000 | 1800 |

In case where the glass coating is baked at a high temperature (above 850° C.), the non-linear coefficient, one of characteristics of the resistor, is not reduced at all by the baking treatment.

EXAMPLE 5

In the same manner as in Example 1, moldings having a diameter of 56 mm and a thickness of 22 mm were sintered at 1300° C. for 1 hour. On the side faces of the sintered bodies were coated glasses whose compositions are shown in Table 7. The glass coatings were baked at temperatures shown in Table 7, and the both end faces of the resulting bodies were polished and rinsed. Thereafter, aluminum electrodes were formed by flash-deposition.

The resulting resistors were subjected to measurements of non-linear coefficients at a current of 10 μA to 1 mA, an initial impulse current resistance, an impulse current resistance after corona discharge, an impulse current resistance after immersion in water for 24 hours, an impulse current resistance after immersion in boiling water for 10 hours, and an impulse current resistance after a heat cycle test (1000 cycles of −40° C.⇄150° C.). The results are shown in Table 7.

According to the present invention, there are provided non-linear resistors having a non-linear coefficient of higher 10 and a high impulse current resistance (an initial value, a value after corona test and a value after water immersion test are at least 100 kV), which meet the requirements for non-linear resistors for high voltage use.

The non-linear resistors of the invention are used in a single form as shown in FIG. 1 or in the form of stack comprising a plurality of resistors shown in FIG. 1.

The electrodes can be attached on one surface of the sintered body, although FIG. 1 shows a non-linear resistor having a pair of electrodes formed on opposite end faces.

TABLE 7

| No. | Composition of glass (wt %) $SiO_2$ | $Al_2O_3$ | $B_2O_3$ | PbO | ZnO | CaO | Baking temp. (°C.) | Non-linear coefficient (a) | Impulse (4 × 10 μs) current resistance (kA) initial | after corona test | after immersion in water | after boiling test | After heat cycle test |
|---|---|---|---|---|---|---|---|---|---|---|---|---|---|
| 11 | — | — | — | — | — | — | —* | 35 | 60 | 40 | 35 | 20 | 62 |
| 12 | 85 | 10 | 2 | — | — | 3 | 1350 | 10 | — | — | — | — | — |
| 13 | 75 | 10 | 10 | — | — | 5 | 1100 | 35 | 120 | 121 | 120 | 106 | 103 |
| 14 | 50 | 20 | 10 | 5 | — | 15 | 1000 | 38 | 115 | 114 | 116 | 105 | 101 |
| 15 | 30 | 30 | 10 | — | — | 30 | 1000 | 32 | 110 | 110 | 110 | 103 | 100 |
| 16 | 15 | 30 | 10 | 15 | — | 30 | 900 | 33 | 110 | 95 | 80 | — | — |
| 17 | 45 | 45 | 2 | — | — | 8 | 1200 | 16 | 80 | — | — | — | — |
| 18 | 45 | 30 | 10 | — | — | 15 | 1100 | 34 | 120 | 118 | 117 | 105 | 108 |
| 19 | 70 | 15 | 10 | — | — | 5 | 1050 | 38 | 125 | 125 | 123 | 106 | 107 |
| 20 | 75 | 5 | 10 | — | — | 10 | 1050 | 40 | 123 | 122 | 125 | 80 | 105 |
| 21 | 75 | 1 | 10 | — | — | 14 | 1000 | 32 | 115 | 95 | 80 | — | — |
| 22 | 70 | 20 | 0.2 | — | — | 9.8 | 1350 | 7 | — | — | — | — | — |

TABLE 7-continued

| No. | Composition of glass (wt %) $SiO_2$ | $Al_2O_3$ | $B_2O_3$ | PbO | ZnO | CaO | Baking temp. (°C.) | Non-linear coefficient (a) | Impulse (4 × 10 μs) current resistance (kA) initial | after corona test | after immersion in water | after boiling test | After heat cycle test |
|---|---|---|---|---|---|---|---|---|---|---|---|---|---|
| 23 | 70 | 20 | 0.5 | — | — | 9.5 | 1250 | 31 | 130 | 131 | 129 | 108 | 102 |
| 24 | 70 | 20 | 2 | — | — | 8 | 1100 | 36 | 128 | 128 | 128 | 105 | 103 |
| 25 | 70 | 20 | 8 | — | — | 2 | 1000 | 37 | 115 | 116 | 114 | 102 | 105 |
| 26 | 65 | 20 | 10 | — | — | 5 | 850 | 35 | 105 | 104 | 103 | 100 | 105 |
| 27 | 60 | 15 | 25 | — | — | — | 600 | 7 | 90 | 70 | 65 | — | — |
| 28 | 70 | 20 | — | 0.2 | — | 9.8 | 1350 | 7 | — | — | — | — | — |
| 29 | 70 | 20 | — | 0.5 | — | 9.5 | 1250 | 32 | 121 | 121 | 120 | 119 | 108 |
| 30 | 70 | 20 | — | 2 | — | 8 | 1100 | 33 | 125 | 125 | 123 | 120 | 107 |
| 31 | 70 | 20 | — | 8 | — | 2 | 900 | 35 | 122 | 121 | 123 | 122 | 105 |
| 32 | 65 | 20 | — | 10 | — | 5 | 900 | 35 | 128 | 128 | 125 | 121 | 105 |
| 33 | 60 | 15 | — | 25 | — | — | 750 | 6 | 85 | 75 | 70 | 60 | — |
| 34 | 30 | 10 | — | 60 | — | — | 500 | 5 | 80 | — | — | — | — |
| 35 | 70 | 20 | 0.1 | 0.1 | — | 9.8 | 1350 | 7 | — | — | — | — | — |
| 36 | 70 | 20 | 0.3 | 0.3 | — | 9.5 | 1200 | 31 | 118 | 118 | 117 | 110 | 102 |
| 37 | 70 | 15 | 5 | 10 | — | — | 900 | 35 | 120 | 119 | 120 | 108 | 103 |
| 38 | 70 | 15 | 10 | 5 | — | — | 900 | 36 | 122 | 123 | 120 | 103 | 105 |
| 39 | 55 | 15 | 5 | 10 | — | 15 | 850 | 35 | 106 | 013 | 101 | 101 | 100 |
| 40 | 55 | 20 | — | 8 | 5 | 12 | 950 | 37 | 150 | 152 | 150 | 150 | 150 |
| 41 | 45 | 20 | — | 8 | 15 | 12 | 900 | 36 | 160 | 161 | 158 | 156 | 160 |
| 42 | 35 | 20 | 7 | — | 25 | 13 | 900 | 40 | 175 | 175 | 152 | 136 | 175 |
| 43 | 35 | 15 | 7 | — | 40 | 3 | 900 | 38 | 160 | 90 | 120 | 85 | 160 |

*with no glass coating

Working temperatures and softening temperatures of the glass compositions in Table 7 are as follows:

TABLE 8

| No. | Softening temperature (°C.) | Working temperature (°C.) |
|---|---|---|
| 12 | 1200 | 1350 |
| 13 | 850 | 1150 |
| 14 | 850 | 1080 |
| 15 | 750 | 1050 |
| 16 | 580 | 980 |
| 17 | 1100 | 1250 |
| 18 | 880 | 1120 |
| 19 | 900 | 1150 |
| 20 | 780 | 1100 |
| 21 | 680 | 1000 |
| 22 | 1220 | 1380 |
| 23 | 1050 | 1300 |
| 24 | 920 | 1190 |
| 25 | 850 | 1100 |
| 26 | 750 | 1100 |
| 27 | 600 | 920 |
| 28 | 1220 | 1380 |
| 29 | 1040 | 1260 |
| 30 | 1000 | 1200 |
| 31 | 760 | 1100 |
| 32 | 740 | 1040 |
| 33 | 600 | 900 |
| 34 | 450 | 730 |
| 35 | 1200 | 1370 |
| 36 | 1010 | 1250 |
| 37 | 735 | 1070 |
| 38 | 735 | 1060 |
| 39 | 700 | 1000 |
| 40 | 740 | 1100 |
| 41 | 740 | 1100 |
| 42 | 800 | 1150 |
| 43 | 820 | 1150 |

Compositions No. 12, 16, 17, 21, 22, 27, 28, 33, 34 and 35 are outside of the glass composition of the present invention. These glass compositions exhibit unsatisfactory properties when applied to ZnO system non-linear resistors. Since No. 12 glass having a softening temperature of 1200° C. is baked at 1350° C., which is higher than the sintering temperature of the sintered body, the impulse current resistance is completely insufficient and non-linear coefficient is drastically lowered. The glass No. 16 which contains a too small amount of $SiO_2$ gives a non-linear resistor a low impulse current resistance value. No. 16 glass has a softening temperature of 580° C. which seems to be too low for the present invention. Similarly, glass Nos. 21, 27, 33 and 34 glasses have a too low softening temperature and working temperature, and non-linear resistors employing them exhibit low impulse current resistance values.

Glass Nos. 22, 28, 35 and 38 contain a too small amount of $B_2O_3$ or PbO and have a too high softening temperature and working temperature. Therefore, these glasses provide a non-linear resistor with a low impulse current resistance and drastically reduce a non-linear coefficient.

From the facts shown in Table 7 and Table 8, it is apparent that preferred glass compositions useful for the present invention should have a softening temperature of a range of about 700° C. to about 1050° C. and a working temperature of a range of about 1000° C. to 1300° C.

According to Table 8, it is also apparent that when the total amount of $SiO_2$ and $Al_2O_3$ in the glass composition is 50% by weight or more, satisfactory results will be obtained.

What is claimed is:

1. A non-linear resistor of a sintered body containing zinc oxide as the main ingredient and $Bi_2O_3$ as an additional component, comprising the sintered body, a pair of opposite electrodes in electrical contact with the sintered body and an acid-resistant glass coating formed on the exposed surface of said sintered body between said electrodes, wherein said glass coating has a baking temperature of 850° C. or higher, but lower than the sintering temperature for the sintered body and comprises 30 to 75% by weight of $SiO_2$, 0.3 to 15% by weight of at least one of $B_2O_3$ and PbO, 2 to 30 by weight of $Al_2O_3$, less than 30% by weight of alkaline earth metal oxide, less than 40% by weight of ZnO, and less than 25% by weight of $TiO_2$.

2. A non-linear resistor according to claim 1, wherein said glass coating comprises 35 to 75% by weight of $SiO_2$, 0.5 to 10% by weight of at least one of $B_2O_3$ and PbO, 5 to 30% by weight of $Al_2O_3$, and 5 to 40% by weight of ZnO.

3. A non-linear resistor according to claim 1, wherein said glass coating consists essentially of 35 to 45% by weight of $SiO_2$, 15 to 25% by weight of $Al_2O_3$, 1 to 5% by weight of at least one of $B_2O_3$ and PbO, 5 to 15% by weight of ZnO, 10 to 15% by weight of $TiO_2$, less than 5% by weight of an alkali metal oxide, 2 to 10% by weight of an alkaline earth metal oxide, and a small amount of other metal oxides.

4. A non-linear resistor according to claim 1, claim 2 or claim 3, wherein a high resistant layer contiguous to the surface of said sintered body comprising $Zn_7Sb_2O_{12}$ and $ZnSiO_4$ is formed beneath the glass coating.

5. A non-linear resistor according to claim 1, claim 2 or claim 3, wherein the sintered body comprises more than 50 molar % of ZnO, 0.01 to 10 molar % of $Bi_2O_3$, and 0.01 to 10 molar % by weight of at least one of $MnO_2$, $Co_2O_3$, $Cr_2O_3$, $B_2O_3$, $SiO_2$ and NiO.

6. A non-linear resistor according to claim 1, claim 2 or claim 3, wherein said glass coating has been baked at a temperature ranging between 850° and 1300° C.

7. A non-linear resistor according to claim 1, claim 2 or claim 3, wherein the thickness of the glass coating is more than 20 μm.

8. A non-linear resistor of a sintered body containing zinc oxide as the main ingredient and $Bi_2O_3$ as an additional component, comprising the sintered body, a pair of opposite electrodes in electrical contact with the sintered body, and an acid-resistant glass coating formed on the exposed surface of said sintered body between said electrodes, wherein said glass coating has a baking temperature of 850° C. or higher, but lower than the sintering temperature for the sintered body, and comprises 30 to 75% by weight of $SiO_2$. 0.3 to 15% by weight of at least one of $B_2O_3$ and PbO, 2 to 30% by weight of $Al_2O_3$, less than 30% by weight of an alkaline earth metal oxide, less than 40% by weight of ZnO, and less than 25% by weight of $TiO_2$; the total amount of $SiO_2$ and $Al_2O_3$ being at least 50% by weight.

9. A non-linear resistor according to claim 1 or claim 8, wherein said glass coating consists essentially of 35 to 75% by weight $SiO_2$, 0.5 to 10% by weight of $B_2O_3$ and/or PbO, 5 to 30% by weight of $Al_2O_3$, 5 to 40% by weight of ZnO, less than 30% by weight of an alkaline earth metal oxide and less than 25% of $TiO_2$.

10. A non-linear resistor according to claim 1, claim 8, or claim 9, wherein said sintered body consists essentially of at least 50 molar % of ZnO, 0.01 to 10 molar % of $Bi_2O_3$ and 0.01 to 10 molar % by weight of at least one oxide selected from the group consisting of $MnO_2$, $Co_2O_3$, $Cr_2O_3$, $B_2O_3$, $SiO_2$ and NiO.

* * * * *